US006755588B1

(12) United States Patent
Tsujikura

(10) Patent No.: US 6,755,588 B1
(45) Date of Patent: Jun. 29, 2004

(54) BALL FOR BALL-POINT PEN

(75) Inventor: Yoshihiko Tsujikura, Nara-ken (JP)

(73) Assignee: Tsubaki Nakashima Co., Ltd., Nara-ken (JP)

( * ) Notice: Subject to any disclaimer, the term of this patent is extended or adjusted under 35 U.S.C. 154(b) by 25 days.

(21) Appl. No.: 10/638,502

(22) Filed: Aug. 11, 2003

(30) Foreign Application Priority Data

Aug. 14, 2002 (JP) ..... 2002-236370

(51) Int. Cl.[7] ..... B43K 7/10
(52) U.S. Cl. ..... 401/215; 401/209
(58) Field of Search ..... 401/208, 209, 401/215, 216

(56) References Cited

U.S. PATENT DOCUMENTS 3,966,336 A * 6/1976 Lotfallah ..... 401/209
5,520,473 A * 5/1996 Durham ..... 401/216
5,762,434 A * 6/1998 Nagashima et al. ..... 401/209
6,161,977 A * 12/2000 Furukawa ..... 401/209

FOREIGN PATENT DOCUMENTS

JP 10-250280 9/1998
JP 10-329473 12/1998
JP 2000-168286 A 6/2000
JP 2002-103871 A 4/2002

OTHER PUBLICATIONS

Yoshinobu Tanaka and Hideo Tsuwa "Methods of Precision Machining—Lower Volume", 1st Edition, 16th Print, Kyoritsu Shuppan Co., Ltd.., Apr. 10, 1974, p. 352.

* cited by examiner

*Primary Examiner*—Tuan N. Nguyen
(74) *Attorney, Agent, or Firm*—Howson and Howson

(57) ABSTRACT

A ball-point pen is made to satisfy the following relationships: $-2.5<Rs\times Rku<1.2$ and $0.005<Ra/S<0.012$, where respective values of Ra or arithmetic average roughness; Rsk or skewness; Rku or kurtosis, which are three-dimensional parameters; and S or average spacing of local peaks which is a two-dimensional parameter, are obtained with a cut-off value set at 0.00132 mm, when surface roughness of the ball is represented by a value in one arbitrary location on the ball surface, namely, inside a circular region thereon whose diameter is 10% of the nominal ball diameter.

1 Claim, 4 Drawing Sheets

| Profile | ADF Curve | Rsk | Rku |
|---|---|---|---|
|  |  | Rsk = 0 | Rku = 3 |
|  |  | Rsk < 0 | Rku > 3 |
|  |  | Rsk > 0 | Rku < 3 |

BALL FOR BALL-POINT PEN

FIELD OF THE INVENTION

This invention relates to a ball for a ball-point pen.

BACKGROUND OF THE INVENTION

A ball for a ball-point pen is held rotatably in a ball holder tip of the ball-point pen, with part of the ball protruding outside the ball holder tip. The ball touches a writing surface, which is usually paper, and serves to transfer ink from an ink supply to the writing surface. This is shown, for example in FIG. 8 of Japanese Patent Application Publication No. JP 2000-168286 A. The term "Patent Application Publication" is hereinafter referred to as "Pub.". The ball generally has a nominal diameter in the range from 0.3 to 1.2 mm. The ball is usually made of a sintered hard material such as a cemented carbide or ceramic.

In the process of writing, the ball rotates while pressure is applied through the ball to the writing surface. Friction occurs at the area of contact between the ball and a conical ball seat inside the ball holder. This friction abrades the ball seat, and, as a result, the ball tends to sink into the ball holder, as shown in FIG. 13 of the above-mentioned published Japanese application. This phenomenon, which is called "ball drop" or "ball down" by ball-point pen manufacturers, gives rise to several problems. First, smooth rotation of the ball is obstructed, which gives a feel to a writer as if the ball is scratching the writing surface. Second, the ink discharge rate changes from its initial setting, and "blur" or "line-breakage" occurs in written traces. In addition, the ink has a tendency to flow out suddenly, producing large quantities of ink as a blot or smear, which is called "goop". Third, when the contact area in the ball seat is abraded excessively, writing may become impossible. In short, abrasion of the ball seat results in a deterioration in writing performance.

Accordingly, it is desirable that the ball be less prone to abrade the ball seat. The term "writing performance" as used herein in ball evaluation, refers to writing performance from the viewpoint of ball seat abrasion.

In a ball-point pen, there is also a requirement that ink consumption be kept below a standard value for a predetermined writing distance. If the wetting relationship between the ink and the ball, which is hereinafter referred to as "spreadability" of the ink, is too high, the ink discharge becomes excessive, and hence the ink consumption exceeds the standard value.

In addition, there are two opposed problems. If the spreadability of the ink is too high, that is, the ink discharge is excessive, "goop" is prone to occur in the written traces. On the other hand, if the spreadability of the ink is too low, that is, the ink discharge is insufficient, "blur", "line-breakage," or "shade" occur in the written traces. In other words, for proper writing performance, the spreadability of the ink must be within a suitable range.

To address the aforementioned problems, the following balls have been proposed: (1) A ball which has an arithmetic average roughness (Ra) of 5–15 nm, as disclosed in Pub. No. JP 10-250280 A(1998); (2) A ball which has both an arithmetic average roughness (Ra) of 4–10 nm and a maximum height (Ry) of 150 nm or less, as disclosed in Pub. No. JP 10-329473 A(1998); and (3) A ball which has both the arithmetic average roughness (Ra) of 5–25 nm in at least a 50 $\mu$m×50$\mu$m region on the surface and a maximum height difference between peaks and valleys (P–V) of 150–250 nm, as disclosed in Pub. No. JP 2002-103871 A.

However, as shown in Table 1 below, which tabulates the surface roughness of balls made of a cemented carbide and having a nominal diameter of 1 mm, and the evaluation for respective balls performed by a certain ball-point pen manufacturer, I have found that the foregoing problems cannot be solved only by controlling the average roughness (Ra) of the balls. The symbols "○" and "X" in Table 1 denote "acceptable" and "unacceptable" respectively.

TABLE 1

(Cut-off Value: 0.11149 mm)

| | Surface Roughness of Ball Ra [nm] | Writing Performance | Ink Consumption |
|---|---|---|---|
| Product #1 | 30–37 average: 34 | X | ○ |
| Product #2 | 31–33 average: 32 | ○ | X |
| Product #3 | 28–35 average: 31 | X | ○ |
| Product #4 | 23–26 average: 24 | ○ | X |
| Product #5 | 16–18 average: 17 | ○ | X |

In Table 1, the arithmetic average roughness (Ra) of product #1 is the largest among the five products. Therefore, it was expected that the spreadability of the ink would be too high, i.e., the ink discharge would be excessive, and hence the rating for ink consumption would be "X". However, the rating was "○", contrary to the initial expectation. The arithmetic average roughness (Ra) of product #5 was within the range of the proposed values or close to the upper limit values. However, the rating for ink consumption was "X". In addition, the maximum height (Ry) and the maximum height difference between peaks and valleys (P–V) are also parameters, each indicating only a profile variation in a longitudinal sectional direction on the ball surface, just as the arithmetic mean roughness (Ra) does. Hence the use of these two parameters cannot solve the foregoing problems.

For the tests tabulated in Table 1, the arithmetic average roughness (Ra) was obtained as follows. Five balls were sampled at random from each product lot. With a surface texture measuring instrument capable of measuring three-dimensional roughness in a non-contact manner (e.g., "Form Talysurf PGI" produced by Taylor Hobson Ltd.), the surface roughness was measured in one arbitrary location on the surface of each sampled ball, namely, inside a circular region thereon having a diameter of 0.1 mm, which is 10% of the 1 mm nominal diameter of the ball. Then, the cut-off value was set to 0.11149 mm, and the arithmetic average roughness (Ra), which is a three-dimensional parameter, was obtained with this cut-off value.

Insofar as writing performance is concerned, a ball is rated "○" if the ball gives no feel of scratching the writing surface and a smooth feel in writing can be obtained, and it does not produce "blur", "line-breakage", "goop" and "shade" in the written traces. On the other hand, if the ball gives a feel of scratching the writing surface, and a smooth feel in writing cannot be obtained, or if ball produces any one of the following phenomena, namely "blur", "line-breakage", "goop" and "shade" in the written traces, the ball is rated "X".

Insofar as ink consumption is concerned, the spreadability of the ink is suitable, that is, the ink discharge is suitable, and consequently the ball is rated "○", if the ink consumption is below a standard value when the ball is caused to travel against a writing surface over a predetermined writing distance. On the other hand, the spreadability of the ink is too high, that is, the ink discharge is excessive, and the ball is rated "X", if the ink consumption exceeds the standard value when the ball is caused to travel against the writing surface over the predetermined writing distance.

I have carried out research on the properties of the ball carefully taking note of skewness (Rsk), kurtosis (Rku) and the average spacing of local peaks (S), in addition to the arithmetic average roughness (Ra), which is one of the roughness parameters. As a result of my research, I have determined the following. First, when the cut-off value is specified (specifically, when the value is set to 0.00132 mm, as discussed below), the product of the skewness (Rsk) value and the kurtosis (Rku) value, which are three-dimensional parameters, namely, the value of Rsk×Rku, correlates with writing performance. Second, the ratio of the arithmetic average roughness (Ra) value, which is a three-dimensional parameter, to the average spacing of local peaks (S), which is a two-dimensional parameter, namely, the value of Ra/S, correlates with the ink consumption (i.e., the ink discharge). These findings have led me to this invention.

SUMMARY OF THE INVENTION

An object of this invention is to provide a ball for a ball-point pen, which is less prone to abrade a ball seat inside a ball holder of the ball-point pen, and hence is capable of maintaining a pen's initially excellent writing performance over time. Another object of the invention is to provide a ball for a ball-point pen which exhibits suitable spreadability of the ink, and hence can keep ink consumption below a standard value when the ball is caused to travel over a writing surface through a predetermined writing distance.

In order to attain the above objects, in accordance with one aspect of the invention, the ball is made to satisfy the following relations: $-2.5<Rsk\times Rku<-1.2$; and $0.005<Ra/S<0.012$, where respective values of Ra or arithmetic average roughness; Rsk or skewness; Rku or kurtosis which are three-dimensional parameters; and S or average spacing of local peaks, which is a two-dimensional parameter, are obtained with a cut-off value set to 0.00132 mm, when the surface roughness of the ball is represented by a value in one arbitrary location on the ball surface, namely, inside a circular region thereon having a diameter which is 10% of the nominal ball diameter. The ball structured as described above exhibits the following advantages.

With Rsk and Rku obtained with a cut-off value set to 0.00132 mm, and the product of the skewness (Rsk) value and the kurtosis (Rku) value satisfying the relation $-2.5<Rsk\times Rku<-1,2$, the ball becomes less prone to abrade the ball seat inside the ball holder, and hence the ball is capable of maintaining the initial excellent writing performance of the ball-point pen.

With Ra and S obtained with a cut-off value set to 0.00132 mm, and the ratio of the arithmetic mean roughness Ra to the average spacing of local peaks S satisfying the relation of $0.005<Ra/S<0.012$, the spreadability of the ink, i.e., the ink discharge, becomes suitable, and hence the ink consumption can be kept below the standard value when the ball is caused to travel over the predetermined writing distance. Furthermore, the writing performance of the ball from the viewpoint of the spreadability of the ink is improved.

BRIEF DESCRIPTION OF THE DRAWINGS

The above and other objects, features and advantages of the invention will be apparent from the following detailed description of the preferred embodiments of the invention in conjunction with the accompanying drawings, in which.

DETAILED DESCRIPTION OF THE PREFERRED EMBODIMENTS

Figure 1:
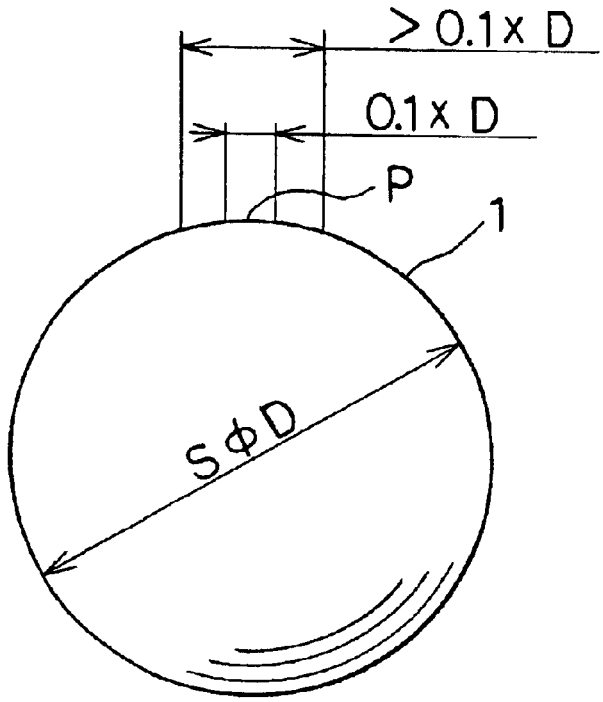
FIG. 1 is a schematic view of a ball, explaining the region in which surface roughness of the ball is determined, this region being inside a circle on the ball surface, the diameter of which circle is 10% of the nominal ball diameter.

Since the structure of a ball holder tip of a ball-point pen is well-known as shown in FIG. 8 of Pub. No. JP 2000-168286 A, an illustration thereof is omitted in the drawings.

Surface roughness of a ball for a ball-point pen may be represented by a value in one arbitrary location on the ball surface, namely, inside a circular region thereon, the diameter of which is 10% of the nominal ball diameter. Balls are finished to provide a uniform surface by a well-known lapping process. (See, e.g., Yoshinobu Tanaka and Hideo Tsuwa, a joint work, "Methods of Precision Machining-Lower Volume", 1st Edition, 16th Print, Kyoritsu Shuppan Co. Ltd., Apr. 10, 1974, p. 352.) Therefore, the surface roughness of a ball can be represented by a value in one arbitrary location on the ball surface.

The surface roughness of the ball may be obtained in a non-contact manner using the above-mentioned surface texture measuring instrument. In this case, the ball is held stationary. As seen in FIG. 1, which is a schematic illustration, the height of a ball 1 is greatest at the apex P, and becomes less with increasing distance from the apex. Therefore, if the region in which the measurement is to be taken is too wide, the reliability of the value to be obtained is impaired. I have tried several settings, and have come to the conclusion that a reliable value can be obtained if the region in which the surface roughness of the ball 1 is obtained is inside a circle the diameter of which is 10% of the nominal ball diameter D, for balls of various nominal diameters.

The expression "Ra or arithmetic average roughness, which is a three-dimensional parameter" is used herein. The arithmetic average roughness (Ra) which is a two-dimensional parameter means an arithmetic average deviation from an average line, as also defined in JIS B 0601-1994. It is considered that a smaller arithmetic average roughness (Ra) value is preferable for the ball from a viewpoint of making the ball less prone to abrade a ball seat inside the ball holder, as disclosed in Pub. No. JP 10-250280 A(1998), etc. However, when the arithmetic average roughness (Ra) value is too small it gives rise to several problems. Spreadability of the ink becomes too small, that is, ink discharge becomes insufficient, and hence "blur", "line-breakage" or "shade" may occur in written traces. Friction between the ball and the writing surface also becomes too small, and hence the ball skids on the writing surface instead of rotating thereon. I have compared and examined the two-dimensional parameters with the values which are the three-dimensional parameters on the arithmetic average roughness (Ra) of various balls. The results showed a slight difference between both values. I then decided to adopt the three-dimensional arithmetic average roughness (Ra) value from the viewpoint of making Ra coordinate with the skewness (Rsk) and kurtosis (Rku), which are three-dimensional parameters.

Figure 4:
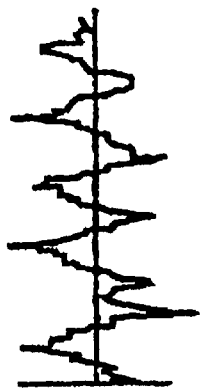
FIG. 4 is a table illustrating various different profiles of a ball surface in two dimensions, their amplitude-density functions, and their Rsk (skewness) and Rku (kurtosis) values.
Figure 4:
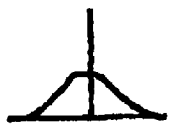
Figure 4:
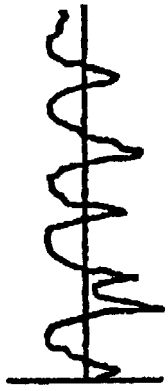
Figure 4:
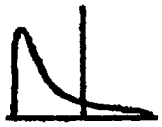
Figure 4:
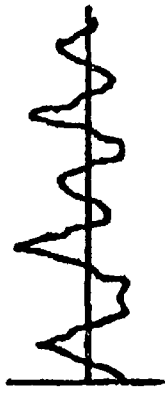
Figure 4:
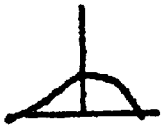

The expression "Rsk or skewness which is a three-dimensional parameter" is also used herein. The skewness (Rsk) which is a two-dimensional parameter means a measure of symmetry of a profile about an average line. As shown in FIG. 4, this skewness (Rsk) takes a negative value when the distribution of the profile is biased toward the lower side, whereas the skewness (Rsk) takes a positive value when the distribution thereof is biased toward the upper side. Furthermore, when the skewness (Rsk) is a negative value, the kurtosis (Rku) value becomes larger than 3. A negative skewness (Rsk) value for the ball is preferable from the viewpoint of making the spreadability of the ink suitable. I have also compared and examined the two-dimensional parameters with the three-dimensional parameters of the skewness (Rsk) of various balls. The results indicated that the two-dimensional parameters scatter and have no qualitative tendency, whereas the three-dimensional parameters have a qualitative tendency. I have decided to adopt the skewness (Rsk) value which is the three-dimensional parameter.

The expression "Rku or kurtosis which is a three-dimensional parameter" is also used herein. The kurtosis (Rku) which is a two-dimensional parameter means a measure of the sharpness of the ADF (Amplitude Density Function) curve and of the "spikiness" of a surface. The spikiness does not necessarily mean the sharpness of individual peaks and valleys. The sharper the ADF curve, the larger the value. The kurtosis (Rku) values can range from 0 to 8. In addition, as shown in FIG. 4, the kurtosis (Rku) is also a measure of randomness of profile heights, and a perfectly random surface has a kurtosis of 3. A kurtosis (Rku) value larger than 3, corresponds to blunt peaks, and is preferable from the viewpoint of making the ball less prone to abrade the ball seat inside the ball holder.

I have also compared and examined the two-dimensional parameters with the three-dimensional parameters on the kurtosis (Rku) of various balls. The results obtained were similar to those for skewness (Rsk). I therefore decided to adopt the skewness (Rsk) value which is the three-dimensional parameter.

The expression "S or average spacing of local peaks which is a two-dimensional parameter" is also used herein. The average spacing of local peaks (S), which is the two-dimensional parameter, means an average spacing of adjacent local peaks over an evaluation length, as also defined in JIS B 0601-1994. A local peak means a highest point between two adjacent minima. A smaller (S) value, i.e. a smaller average spacing of local peaks, is preferable for the ball from the viewpoint of making the spreadability of the ink suitable. The reason is that a ball having a small average spacing of local peaks (S) possesses a larger surface area than a ball having a large S value when the ball is observed microscopically. Here, there is shown one example of results obtained by measuring surface roughness of a ball made of a cemented carbide and having a nominal diameter of 1 mm, with the above-mentioned surface texture measuring instrument.

Figure 2:
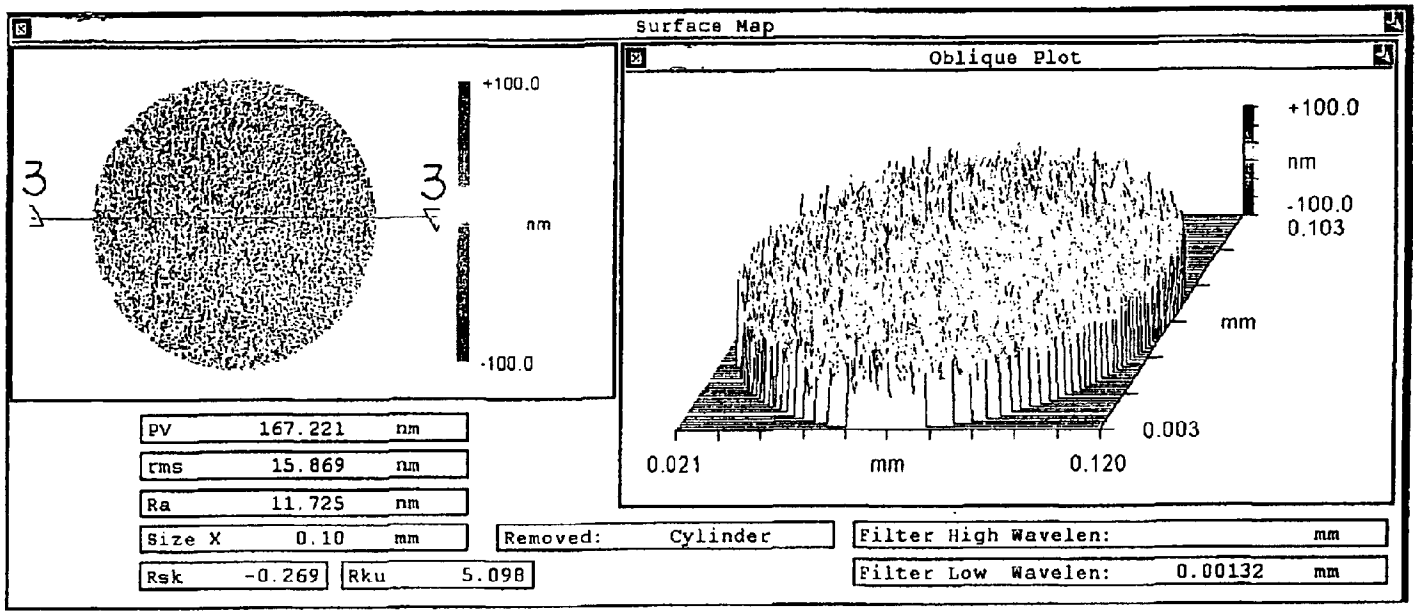
FIG. 2 is a graph illustrating an example of results obtained by measuring the surface roughness of a ball made of cemented carbide and having a nominal diameter of 1 mm, using a surface texture measuring instrument, the surface roughness being depicted in three-dimensions.
Figure 3:
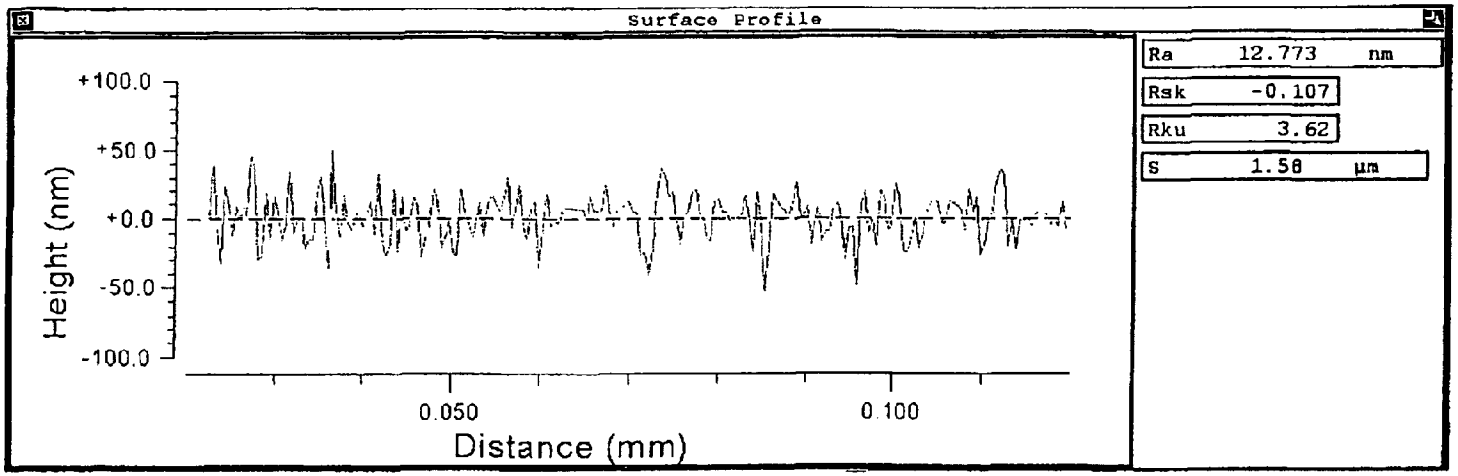
FIG. 3 is a cross-sectional profile taken along line 3—3 in FIG. 2, indicating surface roughness as a two-dimensional parameter.

Whereas FIG. 2 indicates the results as the three-dimensional parameter, FIG. 3 is a cross-sectional profile taken along line 3—3 in a circle shown in FIG. 2, namely, one that is indicated as the two-dimensional parameter. In FIG. 2, an indication "Size×0.10 mm" means that a region to be measured is in one arbitrary location on the ball surface, namely, inside a circle thereon the diameter of which is 0.1 mm, signifying 10% of the 1 mm nominal diameter. The indication "Filter Low Wavelen: 0.00132 mm" in the same figure means that the cut-off value is 0.00132 mm. Incidentally, although it cannot be shown in the drawings the original version of FIG. 2 is a representation in color, where the median is indicated in yellow phase; the positive side in red phase; and the negative side in blue phase, respectively.

Next, there will be described surface roughness of various balls made of cemented carbide and having a nominal diameter of 1 mm, which were produced by varying lapping conditions. An evaluation of the respective balls was performed by a certain ball-point manufacturer. Tables 2 and 3 below show each value of roughness parameters and the evaluation results thereof when cut-off values are set to 0.00132 mm and 0.05626 mm for the same ball, respectively. Here, the following points may be noted. First, the balls which are relevant to the invention are designated as "embodiments", and the others are designated as "comparative examples". Second, the values "0.00132 mm" and "0.05626 mm" are selected from the cut-off values contained in analysis software of the above-mentioned surface texture measuring instrument. Third, the surface roughness value indicates an average which is obtained by measuring five balls sampled at random from each produced lot. Fourth, the criteria of evaluation are the same as those for Table 1.

TABLE 2

(Cut-off Value: 0.00132 mm)

| | Surface roughness parameters of ball | | | | | | Evaluation Results | |
|---|---|---|---|---|---|---|---|---|
| | | | | | | | Writing | Ink |
| | Ra[nm] | Rsk | Rku | S [μm] | Rsk × Rku | Ra/S | Performance | Consumption |
| Embodiment 1 | 12.423 | −0.243 | 5.171 | 1.524 | −1.256 | 0.0082 | ○ | ○ |
| Embodiment 2 | 14.447 | −0.215 | 5.922 | 1.524 | −1.273 | 0.0095 | ○ | ○ |
| Embodiment 3 | 11.790 | −0.249 | 5.930 | 1.636 | −1.477 | 0.0072 | ○ | ○ |
| Embodiment 4 | 18.415 | −0.274 | 6.169 | 1.536 | −1.690 | 0.0120 | ○ | ○ |
| Comparative Example 1 | 16.046 | −0.324 | 7.816 | 1.640 | −2.532 | 0.0098 | x | ○ |

TABLE 2-continued (Cut-off Value: 0.00132 mm)

| | Surface roughness parameters of ball | | | | | | Evaluation Results | |
|---|---|---|---|---|---|---|---|---|
| | | | | | | | Writing | Ink |
| | Ra[nm] | Rsk | Rku | S [μm] | Rsk × Rku | Ra/S | Performance | Consumption |
| Comparative Example 2 | 22.265 | −0.166 | 7.775 | 1.586 | −1.291 | 0.0140 | ○ | x |
| Comparative Example 3 | 22.702 | −0.316 | 7.781 | 1.580 | −2.459 | 0.0144 | ○ | x |
| Comparative Example 4 | 25.691 | −0.286 | 8.291 | 1.678 | −2.371 | 0.0153 | ○ | x |
| Comparative Example 5 | 10.599 | −0.229 | 4.915 | 1.522 | −1.126 | 0.0070 | x | ○ |
| Comparative Example 6 | 6.741 | −0.163 | 4.091 | 1.462 | −0.667 | 0.0046 | x | x |
| Comparative Example 7 | 15.863 | −0.511 | 11.388 | 1.652 | −5.819 | 0.0096 | x | ○ |

TABLE 3

(Cut-off Value: 0.005626 mm)

| | Surface roughness parameters of ball | | | | | | Evaluation Results | |
|---|---|---|---|---|---|---|---|---|
| | | | | | | | Writing | Ink |
| | Ra[nm] | Rsk | Rku | S [μm] | Rsk × Rku | Ra/S | Performance | Consumption |
| Embodiment 1 | 13.972 | −2.850 | 55.677 | 2.310 | −158.68 | 0.0060 | ○ | ○ |
| Embodiment 2 | 16.626 | −1.481 | 35.919 | 2.266 | −53.20 | 0.0073 | ○ | ○ |
| Embodiment 3 | 15.230 | −2.488 | 32.511 | 2.328 | −80.89 | 0.0065 | ○ | ○ |
| Embodiment 4 | 26.884 | −0.667 | 33.342 | 2.612 | −22.24 | 0.0103 | ○ | ○ |
| Comparative Example 1 | 25.496 | −2.150 | 36.869 | 2.866 | −79.27 | 0.0089 | x | ○ |
| Comparative Example 2 | 38.084 | −1.595 | 21.299 | 2.984 | −33.97 | 0.0128 | ○ | x |
| Comparative Example 3 | 38.347 | −1.292 | 21.083 | 2.724 | −27.24 | 0.0141 | ○ | x |
| Comparative Example 4 | 50.883 | −2.051 | 16.076 | 3.008 | −32.97 | 0.0169 | ○ | x |
| Comparative Example 5 | 11.852 | −1.420 | 15.152 | 2.274 | −21.52 | 0.0052 | x | ○ |
| Comparative Example 6 | 6.636 | −1.030 | 8.332 | 2.148 | −8.58 | 0.0031 | x | x |
| Comparative Example 7 | 30.846 | −3.150 | 30.186 | 3.278 | −95.09 | 0.0094 | x | ○ |

Tables 2 and 3 have made the several matters apparent. First, when the cut-off value is specified as 0.00132 mm, the product of the skewness (Rsk) value and the kurtosis (Rku) value which are three-dimensional parameters, namely, a value of Rsk Rku correlates with writing performance. Any ball rated "○" for writing performance has satisfied the relation of $-2.5<Rsk \times Rku<-1.2$. Second, the ratio of the arithmetic average roughness (Ra) value, which is the three-dimensional parameter, to the average spacing of local peaks (S) value, which is the two-dimensional parameter, namely, a value of Ra/S correlates with the ink consumption (i.e., ink discharge). More particularly, any ball rated "○" for ink consumption has satisfied the relation $0.005<Ra/S<0.012$. Accordingly, in order for a ball to be rated "○" both for writing performance and for ink consumption, the ball must satisfy the following relations: $-2.5<Rsk \times Rku<-1.2$ and $0.005<Ra/S<0.012$, where respective values of the arithmetic average roughness (Ra), the skewness (Rsk), the kurtosis (Rku), which are three-dimensional parameters, and the average spacing of local peaks (S) which is a two-dimensional parameter, are obtained with the cut-off value set to 0.00132 mm. The ball as described above exhibits the following advantages. The product of the skewness (Rsk) value and the kurtosis (Rku), which are three-dimensional parameters, satisfies the relation $-2.5<Rsk \times Rku<-1.2$. Therefore, the ball becomes less prone to abrade the ball seat inside the ball holder, and hence the ball is capable of maintaining the initial excellent writing performance of the ball-point pen.

The ratio of the arithmetic mean roughness (Ra) value, which is the three-dimensional parameter to the average spacing of local peaks (S) which is a two-dimensional parameter is made to satisfy the relation $0.005<Ra/S<0.012$. Therefore, the spreadability of the ink, i.e., the ink discharge, becomes suitable, and hence the ink consumption can be kept below the standard value when the ball was made to travel over a predetermined writing distance. Furthermore, the writing performance from the viewpoint of spreadability of the ink can be improved. The foregoing invention has been described in terms of preferred embodiments. However, those skilled, in the art will recognize that many variations of such embodiments exist. Such variations are intended to be within the scope of the invention and the appended claims.

What is claimed:

1. A ball for a ball-point pen, in which $-2.5<Rsk\times Rku<-1.2$ and $0.005<Ra/S<0.012$, where respective values of Ra or arithmetic average roughness; Rsk or skewness; Rku or kurtosis, which are three-dimensional parameters, and S or average spacing of local peaks, which is a two-dimensional parameter, are obtained with a cut-off value set to 0.00132 mm, when surface roughness of the ball is represented by a value in one arbitrary location on the ball surface, namely, inside a circular region thereon the diameter of which is 10% of the nominal diameter of the ball.

* * * * *